US006930639B2

(12) United States Patent
Bauregger et al.

(10) Patent No.: US 6,930,639 B2
(45) Date of Patent: Aug. 16, 2005

(54) DUAL-ELEMENT MICROSTRIP PATCH ANTENNA FOR MITIGATING RADIO FREQUENCY INTERFERENCE

(75) Inventors: Frank N. Bauregger, Mountain View, CA (US); Per Enge, Mountain View, CA (US); Todd Walter, Mountain View, CA (US); Dennis Akos, Palo Alto, CA (US)

(73) Assignee: The Board of Trustees of the Leland Stanford Junior University, Stanford, CA (US)

( * ) Notice: Subject to any disclaimer, the term of this patent is extended or adjusted under 35 U.S.C. 154(b) by 105 days.

(21) Appl. No.: 10/390,331

(22) Filed: Mar. 14, 2003

(65) Prior Publication Data

US 2003/0214443 A1 Nov. 20, 2003

Related U.S. Application Data

(60) Provisional application No. 60/364,496, filed on Mar. 15, 2002.

(51) Int. Cl.[7] ..... H01Q 1/38; H01Q 1/50

(52) U.S. Cl. ..... 343/700 MS; 343/850

(58) Field of Search ..... 343/732, 767, 343/769, 770, 700 MS, 850, 846, 829, 876, 737, 853, 893; H01Q 1/38, 21/00

(56) References Cited

U.S. PATENT DOCUMENTS

| | | | | |
|---|---|---|---|---|
| 4,410,891 A | * | 10/1983 | Schaubert et al. | 343/700 MS |
| 5,003,318 A | * | 3/1991 | Berneking et al. | 343/700 MS |
| 5,319,378 A | | 6/1994 | Nalbandian et al. | 343/700 |
| 5,461,387 A | | 10/1995 | Weaver | 342/357 |
| 5,486,836 A | * | 1/1996 | Kuffner et al. | 343/700 MS |
| 5,712,641 A | | 1/1998 | Casabona et al. | 342/362 |
| 5,815,112 A | * | 9/1998 | Sasaki et al. | 342/70 |
| 5,877,726 A | * | 3/1999 | Kudoh et al. | 343/700 MS |
| 6,124,829 A | * | 9/2000 | Iwasaki | 343/700 MS |
| 6,252,553 B1 | | 6/2001 | Solomon | 343/700 |

OTHER PUBLICATIONS

P. Ngamjanyaporn et al., "Switched–beam single patch antenna," Electronics Letters, Jan. 3, 2002, vol. 38, No. 1.

* cited by examiner

*Primary Examiner*—Trinh Vo Dinh
(74) *Attorney, Agent, or Firm*—Lumen Intellectual Property Services, Inc.

(57) ABSTRACT

Method and apparatus for reducing radio frequency interference (RFI) using a dual-element patch antenna [10]. The antenna possesses two antenna elements [13, 14] having distinct radiation patterns. Either element may be independently selected using a DC bias voltage. Diodes [20] connected to the elements serve to disable one element when the other is selected. In one selected mode, a nominal radiation pattern provides a broad, hemispherical shaped sensitivity that is designed for acquiring and tracking all navigation satellites above the horizon. This nominal radiation pattern, however, is susceptible to interference that is present near or below the horizon. The second selectable radiation pattern of the dual-element antenna has comparatively higher gain toward zenith, and lower gain at and below the horizon to mitigate interference. This combination of features is packaged in a single antenna unit that can be a direct replacement for existing antennas. The dual-element antenna unit has a low vertical profile and is suitable for mounting on high-speed moving vehicles.

15 Claims, 7 Drawing Sheets

DUAL-ELEMENT MICROSTRIP PATCH ANTENNA FOR MITIGATING RADIO FREQUENCY INTERFERENCE

CROSS-REFERENCE TO RELATED APPLICATIONS

This application claims priority from U.S. provisional patent application No. 60/364,496 filed Mar. 15, 2002, which is incorporated herein by reference.

FIELD OF THE INVENTION

This invention relates generally to radio frequency interference and particularly to patch antennas capable of significantly reducing and/or preventing radio frequency interference to satellite radio navigation systems.

BACKGROUND OF THE INVENTION

Satellite radio navigation systems such as the Global Positioning System (GPS) are valuable tools for the navigation of moving vehicles. These vehicles may be ground or air vehicles, and may be manned or unmanned. Traditionally, GPS antennas for moving vehicles have been microstrip patch antennas which have a low vertical profile and low wind resistance. These antennas are lightweight, inexpensive, and typically only several inches square, and may protrude one or two centimeters above the surface of the vehicle, at most.

Microstrip patch antennas usually comprise just one square or circular metal antenna element attached to a low-loss dielectric substrate. The substrate is mounted on a larger ground plane, which serves as the return path for current induced on the patch element. The microstrip patch antenna performs optimally when it is sized such that the cavity beneath the patch resonates in its fundamental mode ($TM_{100}$ or $TM_{010}$) at the frequency of interest. This occurs when the resonant dimension of the patch is approximately one half-wavelength long within the dielectric substrate. Circularly polarized reception is possible when both the $TM_{100}$ and $TM_{010}$ modes are excited with equal strength, but with a 90° phase shift. Circular polarization is important since most navigation satellites transmit circularly polarized radiation, and therefore a circularly polarized receive antenna is preferred for optimal system performance. While microstrip patch antennas inherently possess a narrow bandwidth, bandwidth enhancement techniques are possible to allow reception of wideband signals. Wide bandwidth antennas act to improve the accuracy of the navigation position solution.

Typical patch antennas have broad hemispherical radiation patterns, which enable them to acquire and track all GPS satellites above the horizon. However, this broad beam also receives radio energy from below the horizon. For ground or airborne vehicles, this undesired energy typically originates from ground-based radio frequency interference (RFI) sources. In both cases, it is possible for the interference to jam the receiver and render it unusable, thus preventing the user from navigating with the satellite radio navigation system.

Several techniques have been employed to combat these problems associated with RFI. A common approach uses an adaptive phased array of patch antennas arranged in a plane. The signals from multiple antennas are combined adaptively in a manner to reduce the interference. One way to combine the signals is to form distinct narrow beams directed at each of the navigation satellites. This is called a beam-steered controlled radiation pattern antenna (CRPA). Another way to combine signals from multiple antennas is to place nulls in the directions of the interference sources. This is called a null-steering CRPA. For an N-element array, the null-steering CRPA can steer N−1 nulls simultaneously. The depth of each null is limited by the number of nulls that are active simultaneously. The beam-steered and null-steering CRPAs must adaptively compute, in real time, the appropriate weightings for the signal combining. This requires expensive external hardware and software, and specialized receiver design. Phased arrays of patch antennas are also quite large, requiring multiple patch antennas sufficiently separated from each other.

Adaptive antenna arrays do not integrate directly with existing aviation or consumer navigation equipment, and therefore their use requires significant retrofit of the vehicle's radio navigation system. While adaptive antenna arrays have impressive interference suppression performance, they are not well suited for consumer or commercial use due to their cost, complexity, and large size. They find use largely in military anti-jam applications.

Various antennas have been designed to yield higher bandwidths. For example, U.S. Pat. No. 5,319,378 issued to Nalbandian et al. discloses a multi-band antenna consisting of a patch element supported by several dielectric layers. This multi-band antenna can be excited in higher order modes allowing multi-frequency operation. However, it does not suppress interference.

U.S. Pat. No. 5,003,318 issued to Berneking et al. describes an antenna comprising a multi-layer patch antenna system designed primarily to increase the receive bandwidth and provide dual-frequency operation. Two circular patch elements are resonant on closely separated frequencies and are excited simultaneously, which broadens the antenna's total frequency response. An adaptive nulling processor is required for suppressing interference. In addition, the vertical structure of this antenna is very complex, requiring specialized manufacturing techniques.

U.S. Pat. No. 5,712,641 issued to Casabona et al. discloses an interference cancellation system for GPS receivers that makes use of polarization diversity. The two orthogonal polarization components are treated independently in two separate channels, and are adaptively weighted and combined in a manner to suppress undesired interference. This antenna system requires external hardware and software to adaptively compute the weightings of the two polarization signals.

U.S. Pat. No. 5,461,387 issued to Weaver describes a direction finding antenna consisting of a four-arm spiral that may be excited in two different modes. Mode 1 maintains a 90° phase shift between the arms and is a very broad pattern useful for receiving all navigation satellites in view. Mode 2 creates a 180° phase shift between the arms, resulting in a null in the direction of the antenna axis. Again, this antenna requires external hardware and software to compute the relative amplitude and phase between the two modes. No mention is made of any interference suppression capabilities of the antenna. Moreover, because of its design, this antenna is not practical for external use on high-speed vehicles.

U.S. Pat. No. 6,252,553 issued to Solomon discloses a multi-mode patch antenna that can steer a null in the direction of a jammer. It employs a single microstrip patch operating in both the fundamental mode ($TM_{100}$ and $TM_{100}$ phased 90° apart) and the second order mode ($TM_{200}$ and $TM_{020}$). The amplitude and phase of these two modes may be adaptively combined in a manner to suppress interference arriving from one direction. One drawback of this design is that only one jammer may be suppressed. In addition, and more importantly, complex external hardware and software are needed to adaptively compute the proper amplitude and phase for the signal combiner. This antenna is a simpler version of the null-steering CRPA, but still requires complex external hardware. As such, it cannot be integrated directly with existing vehicular radio navigation systems.

An antenna capable of switching between two radiation patterns is disclosed in Ngamjanyapom et al., "Switched-beam single patch antenna," *Electronics Letters,* Vol. 38 (2002), No. 1. The antenna comprises a single conducting patch above a ground plane. A combination of forward and reverse biased PIN diodes connect the patch to the ground plane. By reversing the voltage bias to the antenna, the radiation pattern of the patch is switched between two different azimuth radiation patterns: a north-south beam and an east-west beam. Both beams have the same elevation radiation pattern, which does not significantly suppress radiation at or below the horizon. Moreover, both beams significantly suppress signals near zenith, blocking desired signals from GPS satellites overhead. Thus, this antenna would not be useful for improving the signal to interference ratio in satellite radio navigation systems.

U.S. Pat. No. 5,486,836 to Kuffner et al. teaches a dual patch antenna system where the two antennas are physically separated, e.g., located in different parts of the transceiver. This spatial separation of the antennas provides spatial diversity and also isolates the antennas to avoid mutual coupling. One of the two antennas can be selected with an RF switch implemented with PIN diodes. The antenna system, however, has no properties that address the specific problems associated with interference from ground-based RF signal sources in GPS navigational systems. Moreover, because the two antennas must be separated to avoid mutual coupling, the antenna system taught by Kuffner et al. is not compact or integrated.

U.S. Pat. No. 5,877,726 to Kudoh et al. teaches an array antenna system wherein array elements are spatially separated from each other in a diagonal configuration in a common plane. The diagonal staggered arrangement of the elements increases the physical separation between elements and reduces the mutual coupling (i.e., interference) between antenna elements. The antenna system does not have any specific properties that help solve any of the problems associated with interference from ground-based RF signal sources in GPS navigational systems. In addition, the antenna array is not compact since the antennas must be physically separated.

There is therefore a need for a simple, inexpensive, low-profile patch antenna that is able to mitigate radio frequency and multi-path interference to satellite radio navigation systems without requiring modifications to currently installed systems.

SUMMARY OF THE INVENTION

According to one aspect of the invention, an antenna has two patch antenna elements with similar azimuth radiation patterns but distinct elevation radiation patterns. The two antenna elements are in sufficiently close proximity to each other that strong mutual coupling would normally take place, disrupting their independent operation. Nevertheless, the two antenna elements may be operated independently of each other by selectively disabling one or the other of the two elements. More specifically, diodes are used to isolate the two elements from each other and allow selection of just one of the elements so that, in operation, the elements can be used independently, giving the antenna two distinct modes corresponding to the two radiation patterns. One element, having a smaller size, may have a general-purpose, or nominal, pattern. The other element, having a larger size, may have an RFI-resistant pattern that has, comparatively, much less sensitivity at low elevation angles (i.e., near and below the horizon) and much higher sensitivity at high elevation angles (i.e., near zenith).

According to one embodiment of the invention, the two antenna elements and a ground plane are stacked on top of each other, separated by dielectric layers. A common electrical feed may be connected to both antennas. The antennas may have rectangular or square shapes. More generally, the antennas may have various shapes, although regular polygonal shapes are preferred. The smaller antenna may be stacked above the larger antenna, which is stacked above the ground plane. A first set of diodes connects the smaller antenna to the larger antenna, while a second set of diodes connects the larger antenna to the ground plane. The first and second sets of diodes have opposite bias.

According to another embodiment of the invention, the two antenna elements have circular symmetry, are concentric, and have separate electrical feeds. Preferably, the smaller antenna is a disk and the larger antenna is an annulus surrounding the disk. Both the large and small antennas are separated from the ground plane by dielectric layers. A first set of diodes connects the smaller antenna to the ground plane, while a second set of diodes connects the larger antenna to the ground plane. The first and second sets of diodes have opposite bias.

In another aspect of the invention, the antenna further comprises RF feed and DC control circuitry. In one embodiment, the DC control circuitry comprises a diode driver connected to the electrical feed(s), and a voltage comparator connected to the diode driver.

DETAILED DESCRIPTION

Figure 1A:
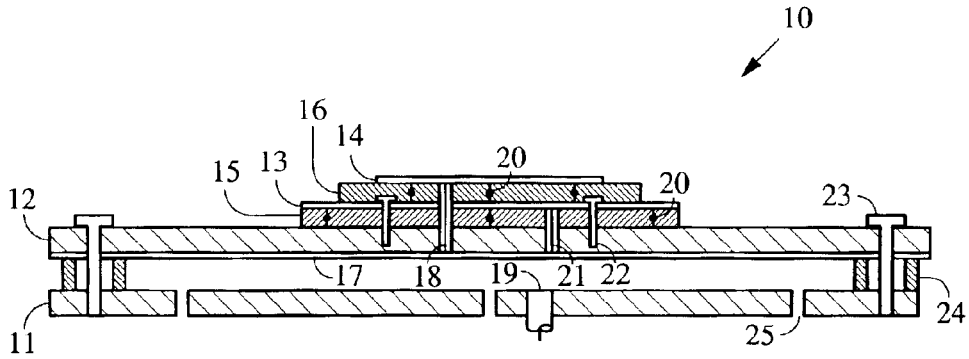
FIGS. 1A–B are two views of a dual-element stacked patch antenna having rectangular symmetry, according to an embodiment of the present invention.
Figure 1B:
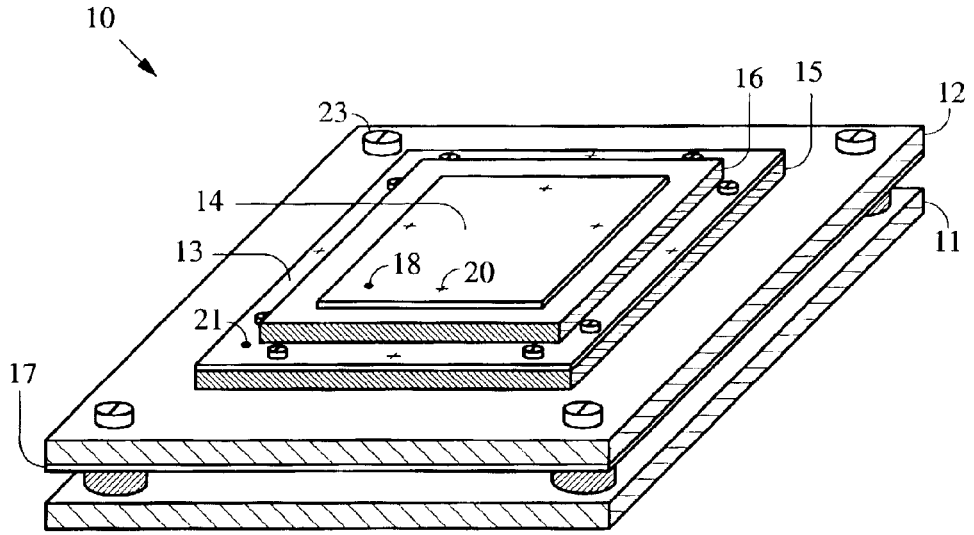

As shown in FIGS. 1A and 1B, an embodiment of the present invention provides a dual-element antenna device comprising two vertically stacked rectangular microstrip patch antenna elements 13 and 14, dielectric substrates 15 and 16, and a conducting ground plate 12. Antenna elements 13 and 14 are stacked above ground plate 12 with substrates 15 and 16 interposed between them. The two patch elements 13 and 14 are fed simultaneously by a common feed 18 located along a diagonal of the rectangular patch elements. The feed 18 is located from the corner of the rectangle of both patches approximately 35 percent of the length of the diagonal. In this configuration, both upper and lower patch elements will be circularly polarized. In addition, the patches are electrically in series with each other. The upper patch 14 operates in the nominal or general purpose mode. When active, the upper patch 14 and the lower patch 13 form a resonant cavity at the frequency of interest, using the upper substrate 16 as the cavity dielectric material. The lower patch 13 operates in the RFI resistant mode, using the lower substrate 15 as the cavity dielectric material, and the ground plane 12 as the other resonant cavity wall. The upper 16 and lower substrates 15 are open to free space on all four sides. These open surfaces define the radiating apertures for the upper 14 and lower patches 13.

The planar antenna elements 13 and 14 are switched on and off by DC bias voltage levels applied to PIN diodes 20, which are connected between each patch element and its respective resonant cavity wall. By altering the bias control voltage level, the antenna can be switched between two modes, one mode where the upper patch is enabled and the lower patch disabled, and another mode where the lower patch is enabled and the upper element is disabled.

The radiation pattern of the antenna in a nominal mode is identical to that of any commonly available patch antenna. In this mode, the upper patch element 14 is activated and the antenna can acquire and track navigation satellites down to an elevation angle of 5° or below. In an RFI resistant mode, the lower patch element 13 is activated, resulting a comparatively higher gain pattern at high elevation angles (i.e., near zenith), and comparatively more resistance to interference at low elevation angles (i.e., at or below the horizon). Using the antenna in this mode improves the ratio of satellite signal to interference by more then a factor of 100 in some cases (e.g., for high elevation satellites). Thus, to jam a high elevation satellite when the RFI resistant mode is selected, a jammer must increase its transmit power one-hundred times or move roughly ten times closer to the vehicle compared to what would be required when the nominal mode is selected (or when using a conventional patch antenna).

The antenna requires no computational resources to combat the interference and requires minimal external hardware, other than a pre-existing DC control signal on the center conductor of the antenna coaxial feed line. The entire functionality of the inventive antenna is built into a single, small antenna package that is roughly the same size as a conventional microstrip patch antenna currently used by moving vehicles. The antenna is lightweight and has a low vertical profile to minimize wind resistance. Since the default mode of operation is the nominal mode, this antenna may replace any existing satellite navigation antenna without substantial modification to the vehicle's satellite navigation system or antenna mounting hardware.

The antenna maintains an advantage over other satellite navigation antennas in that it may be switched between two radiation patterns, either manually or at the discretion of an automatic interference detector already built into many modern satellite navigation receivers. Because the antenna can be selectively switched from a nominal mode to an RFI resistant mode, it provides mitigation of intentional or unintentional interference to the vehicle's navigation system without the complexities associated with adaptive phased arrays.

The ground plane 12 is a conducting material that also provides structural support to the layers above. The size of ground plane 12 is preferably minimized so that the lateral dimension of the structure is not excessive for high-speed vehicles. The ground plane 12 and printed circuit board 17 are bonded with conducting epoxy. This structure is then fastened or attached to the structural support plate 11 by means of machine screws 23 and spacers 24. This added level of structural support is intended to provide a robust antenna that may be mounted on high-speed vehicles without concern for shock and vibration damage. Threaded holes 25 are provided for easy mounting on the vehicle. The output connector 19 (SMA, TNC, or the like) is connected to a 50 ohm coaxial feed line which runs to the navigation satellite receiver antenna input port.

The ground plane and antenna elements may have a suitable symmetric shape, such as a polygon (e.g., square, pentagon, hexagon, or octagon). In the present embodiment, the ground plane is square, and both upper 14 and lower 13 patch elements are rectangular in shape, as is preferred to obtain circular polarization. The upper dielectric substrate 16 preferably has a high dielectric constant so that the size of the upper patch 14 may be minimized. For example, a dielectric constant of 4.75 yields an upper patch element 14 whose edges have a length of approximately one-quarter wavelength at the frequency of interest. The lower dielectric substrate 15 preferably has a very low dielectric constant, near or equal to 1.0. This results in a large lower patch element 13 whose edges have a length of approximately one-half wavelength at the design frequency. It is this property of the lower patch 13 which provides high gain toward the zenith, and very low gain towards the horizon or below. The dielectric constant of the lower substrate 15 might have a value of 1.07, and the lower patch 13 might have an edge length of roughly 47% of the design wavelength. The vertical separation between the ground plane 12 and the lower patch 13, and between the lower patch 13 and the upper patch 14 (i.e., the thickness of each dielectric layer 15 and 16) is typically on the order of 0.02 wavelength.

Both patches 14 and 13 are fed by a common feed 18. The feed 18 is connected only to the upper patch element 14. Placed in this configuration, the patches are electrically in series with each other. As seen in FIG. 1B, the feed 18 is placed along a diagonal of the upper 14 and lower 13 patch elements so as to simultaneously obtain circular polarization and a match to 50 ohms input impedance.

The upper 14 and lower 13 patch elements are switched on and off using DC control bias voltage levels in conjunction with two sets of PIN diodes 20, which are connected between the upper 14 and lower 13 patch elements and their respective lower cavity walls, 13 and 12, respectively. When a particular set of diodes is reverse biased, they posses a large capacitive reactance, and are essentially out of the circuit. This allows operation of the particular patch cavity that they bridge, enabling the associated antenna element. When the diodes are forward biased, they posses a low resistance and inductive reactance. This prevents excitation of the fundamental modes within the patch cavity, effectively disabling the antenna element. A DC control voltage on the center conductor of the coaxial cable connecting the satellite receiver to the antenna 19 is used to drive the control circuit. This circuitry is preferably mounted on a printed circuit board 17 that fits within the antenna 10.

Figure 2:
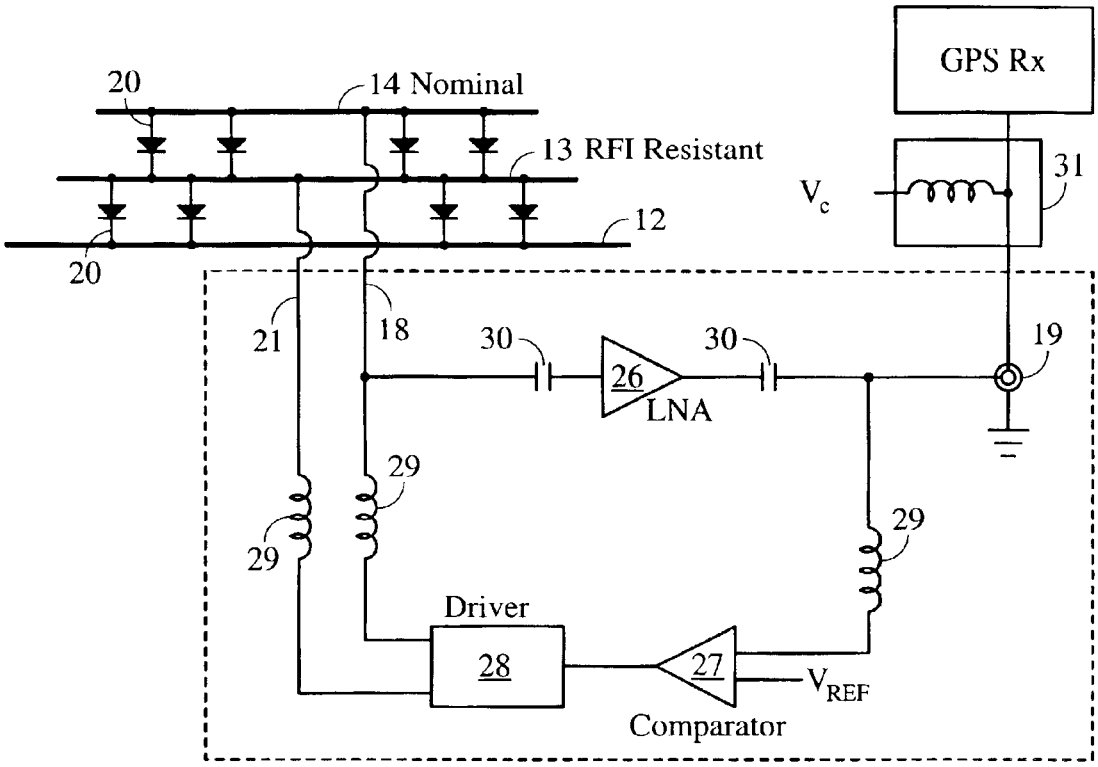
FIG. 2 is a schematic block diagram of the electronic circuitry of the embodiment shown in FIGS. 1A–B.

A block diagram of the RF feed and DC control circuitry for the antenna is shown in FIG. 2. A low noise amplifier 26 immediately follows the feed 18 so as to provide a low system noise figure for the satellite receiver. DC blocking capacitors 30 isolate the low noise amplifier from the DC control voltages. RF chokes 29 de-couple the DC control voltage from the center conductor of the feed line. The de-coupled control voltage is fed to the comparator 27 which controls the PIN diode driver 28. The driver 28 manages the voltages and currents which are fed to the PIN diodes 20.

When the control voltage $V_c$ ranges between +3 and $V_{ref}$ volts DC ($+3<V_c<V_{ref}$), the upper nominal patch antenna 14 is activated. $V_{ref}$ is typically set to +7.5 volts DC, and $V_c$ is nominally +5 volts DC. When the control voltage $V_c$ exceeds $V_{ref}$ volts DC ($V_c>V_{ref}$), the RFI resistant patch antenna 13 is activated. In this case, $V_c$ is nominally +12 volts DC, as this is a commonly available voltage found in satellite navigation receivers. Since nearly all modern navigation satellite receivers provide +5 volts DC to the antenna to drive a low noise amplifier, the antenna described herein is directly compatible with current receiver designs, operating in nominal mode and thus providing maximum navigation satellite reception with no modification by the user.

To select the RFI resistant mode, the control voltage may be applied manually inside the vehicle by installing a bias-Tee 31 in the receive signal path, and connecting an external power supply to provide the control signal. This additional hardware may be omitted if the satellite navigation receiver has an interference detector, and appropriate software to manage the control voltage. Many modern satellite navigation receivers have built-in interference detectors. In order to automate switching the control voltage, simple changes to the receiver architecture may be required.

Figure 3:
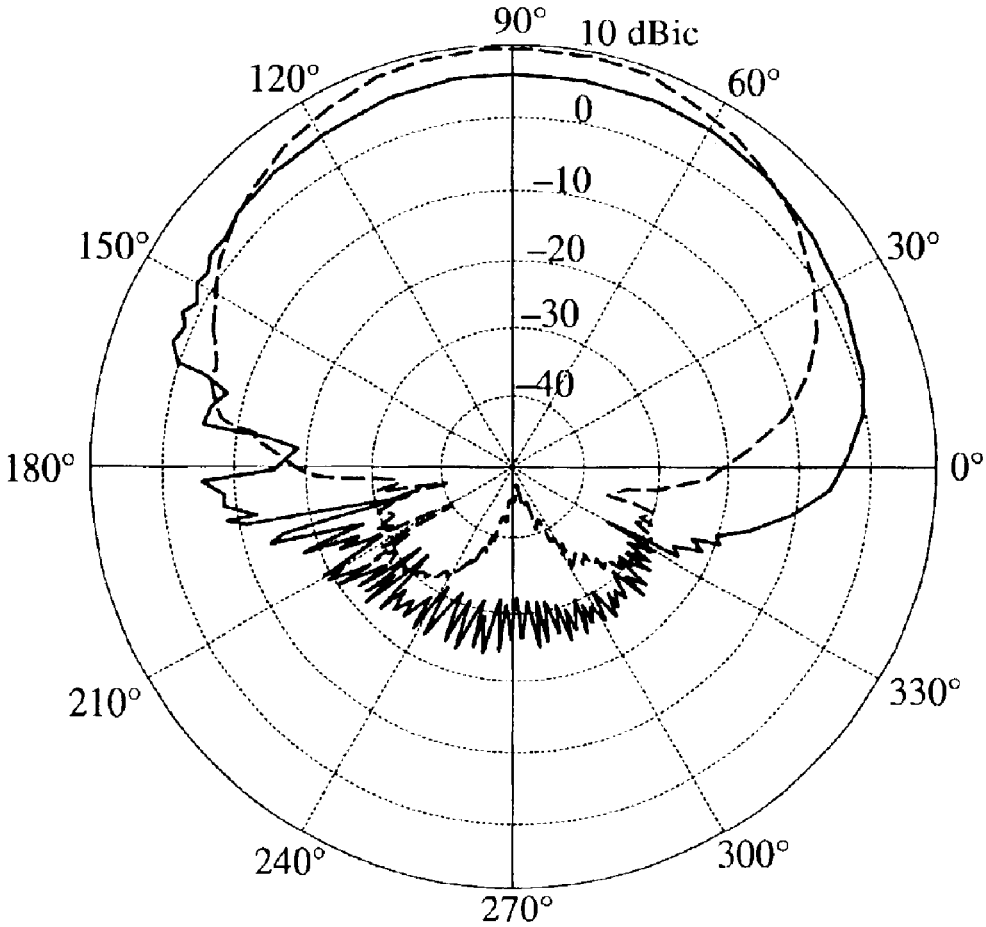
FIG. 3 is a graph of antenna response vs. elevation angle for two operational modes of the antenna shown in FIGS. 1A–B.

The two selectable radiation pattern modes of the antenna at the GPS L1 frequency of 1575.42 MHz are shown in FIG. 3. Compared to the nominal mode pattern (solid line), the RFI resistant pattern (dashed line) has a higher sensitivity at zenith (near 90 degrees elevation angle) and a lower sensitivity at and below the horizon (elevation angles around 0 degrees and lower). The patterns in FIG. 3 are computed in the pitch plane for the antenna mounted on a Cessna Caravan general aviation aircraft. The control voltage $V_c$ is set to +5 VDC for nominal operation. This antenna mode has a maximum gain of 6 dBic for high elevation satellites. The pattern tapers off slowly near the horizon. This antenna mode will acquire and track navigation satellites down to an elevation angle near 5°. However, because the radiation pattern does not fall off sharply below the horizon, this antenna will be susceptible to interference arriving from below the aircraft. In contrast, the radiation pattern of the antenna in the RFI resistant mode, with $V_c$ set to +12 VDC ($V_c>V_{ref}$), has a high gain of 9 dbic toward the zenith and a much lower gain at low elevation angles. It is clear from FIG. 3 that the RFI-resistant pattern of the lower patch will be less susceptible to interference from below the horizon than the nominal pattern of the upper patch.

Figure 4:
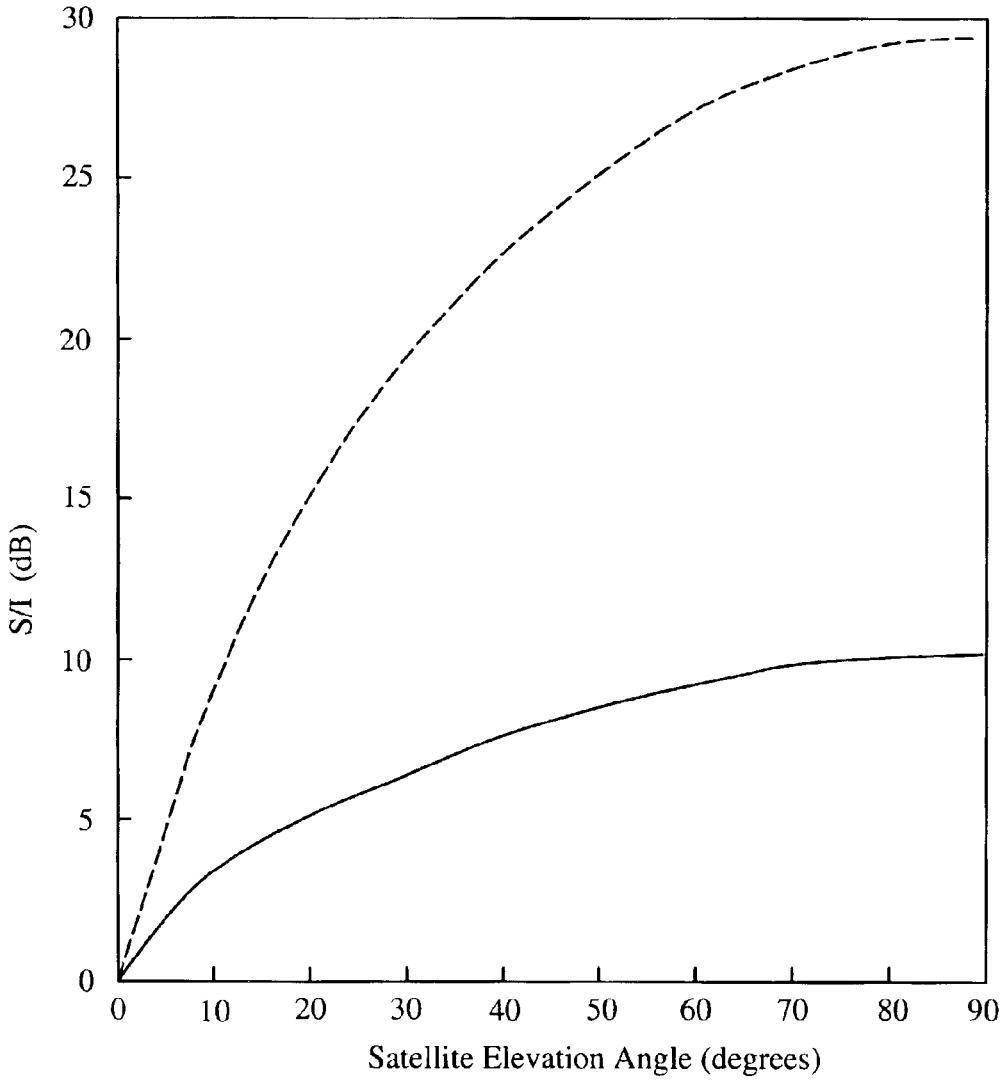
FIG. 4 is a graph of signal-to-interference level vs. satellite elevation angle above the horizon for two operational modes of the antenna shown in FIGS. 1A–B.

The RFI suppression performance of the antenna is shown in FIG. 4 as the ratio (in dB) between the antenna gain toward the desired satellite, and the antenna gain toward the interferer, located at or near the horizon. We refer to this metric as the S/I ratio. The nominal mode patch (solid line) provides at most 10 dB S/I. However, the RFI-resistant mode patch 13 provides as much as 30 dB S/I for high elevation satellites. The improvement in interference suppression afforded by the RFI-resistant mode patch over the nominal mode patch is indicated by the vertical separation between the two graphs, and can be as much as 20 dB for high elevation satellites.

Figure 5:
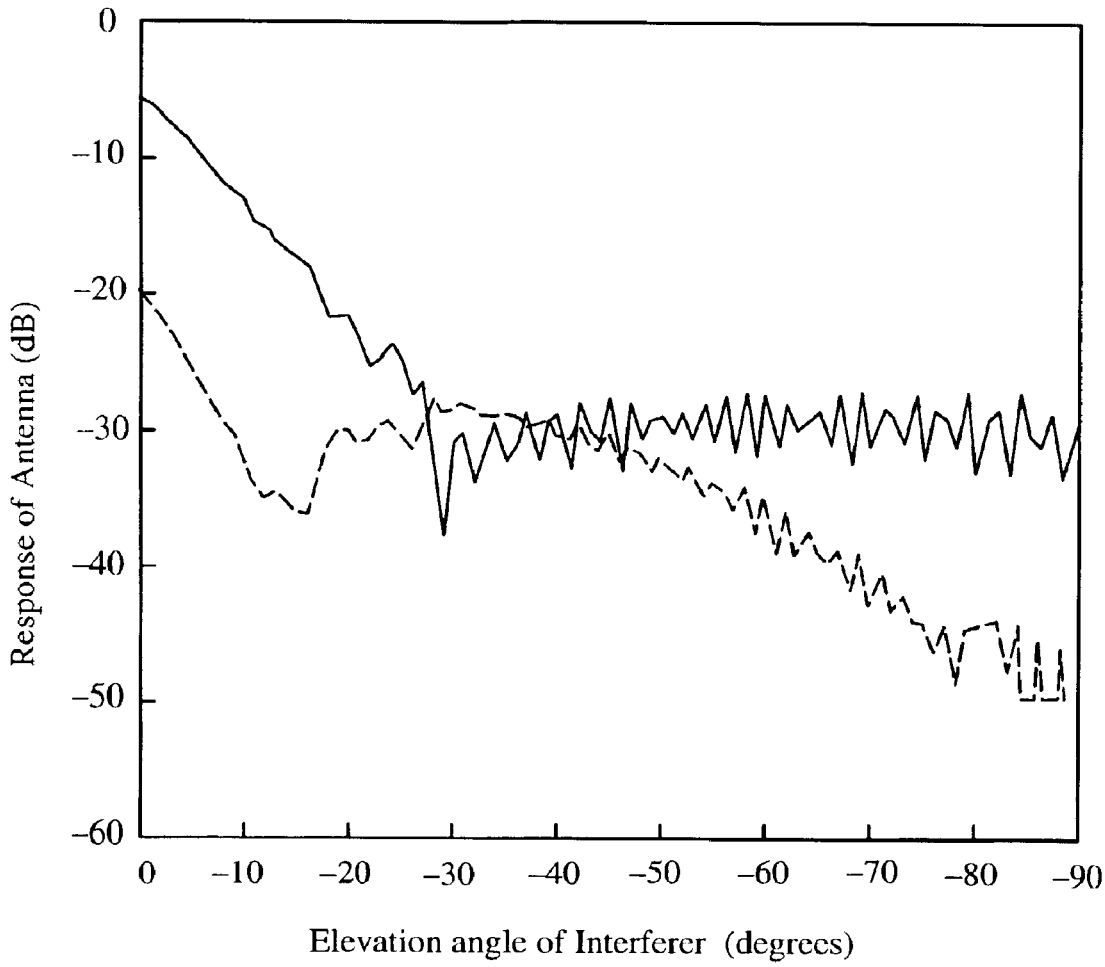
FIG. 5 is a graph of antenna response vs. elevation angle below the horizon for two operational modes of the antenna shown in FIGS. 1A–B.

Another measure of antenna RFI suppression performance is shown in FIG. 5, where the total responses for the nominal and RFI-resistant mode patches are graphed against the elevation angle (below the horizon) of an interfering signal. The response of the RFI-resistant mode patch can be as much as 15 dB lower than that of the nominal mode patch for some interferer elevations. The RFI-resistant mode of the antenna thus provides a significant improvement in interference rejection as compared to the nominal mode.

Figure 6A:
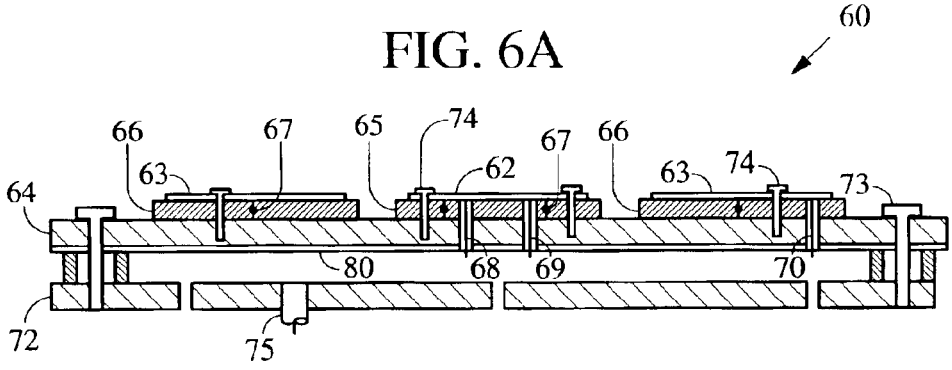
FIGS. 6A–B are two views of a dual-element stacked patch antenna having circular symmetry, according to an embodiment of the present invention.
Figure 6B:
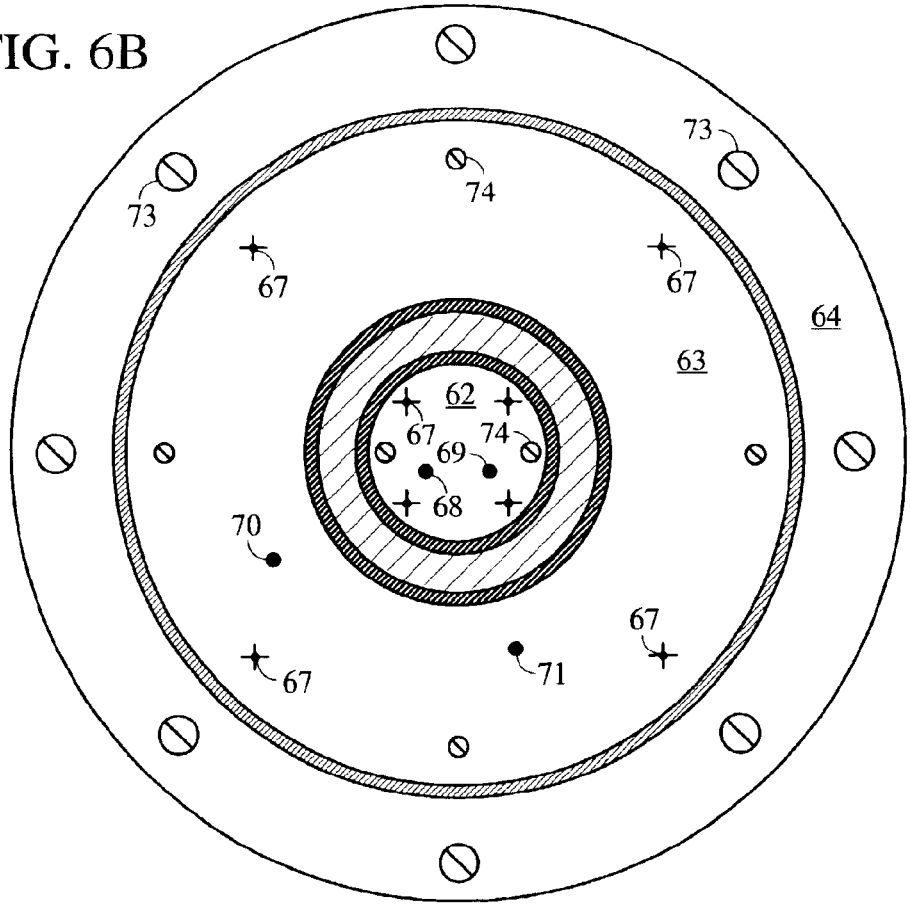

Another embodiment of the invention is illustrated in FIGS. 6A and 6B. In this embodiment the dual-element patch antenna 60 has circular symmetry. Rather than having square antenna elements vertically stacked on each other, an inner antenna element 62 has the shape of a circular disc and an outer antenna element 63 is a concentric annulus. Due to the circular symmetry of this antenna, it has improved spatial phase and group delay characteristics, which are important for obtaining accurate GPS location estimates. Another advantage of this embodiment is that it has better on/off characteristics than the stacked element embodiment because the two antenna elements have a larger physical separation and thus have less interaction. This circular design, however, may be slightly larger than the stacked square design.

Figure 7:
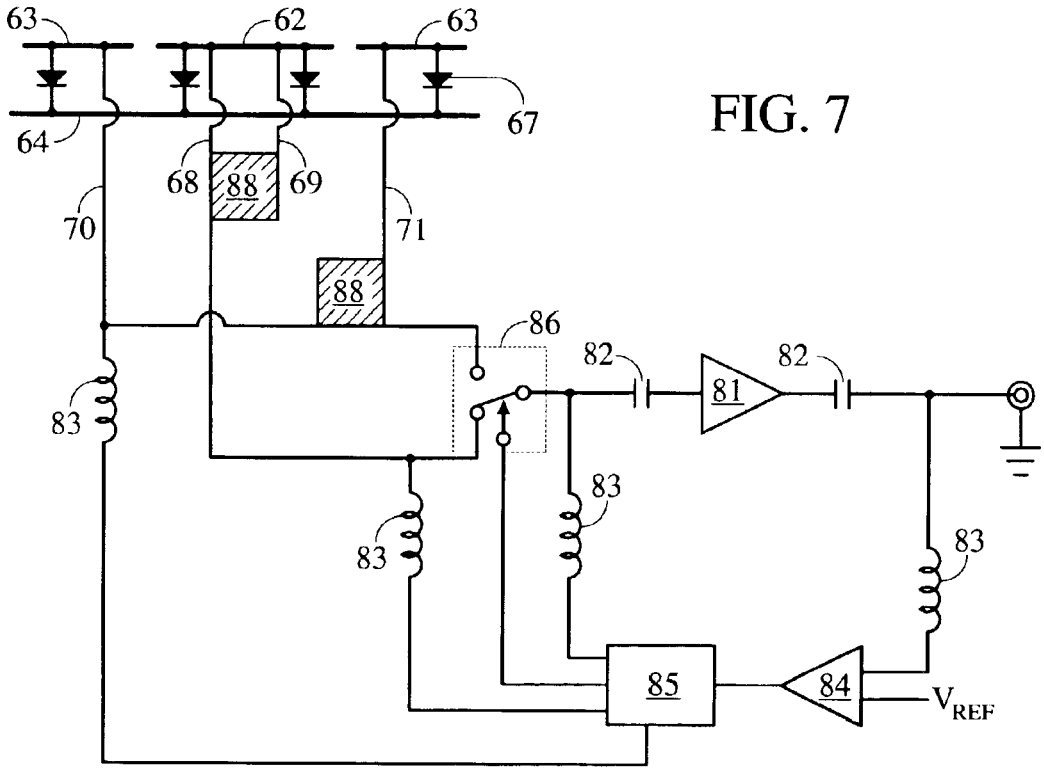
FIG. 7 is a schematic block diagram of the electronic circuitry of the embodiment shown in FIGS. 6A–B.

Both elements 62 and 63 are separated from a circular ground plane 64 by dielectric substrates 65 and 66, respectively. The inner antenna element 62 serves as a nominal mode antenna, while the outer element 63 serves as an RFI-resistant mode antenna. The inner element 62 has a radiation pattern with stronger horizon sensitivity than the radiation pattern of the outer element 63. The radiation pattern of the inner element 62 also has a weaker zenith sensitivity than that of the outer element. In other words, the outer element is more sensitive near zenith and better at rejecting interference near and below the horizon. Two sets of PIN diodes 67 connect the two antenna elements 62 and 63 to the ground plane 64, bridging the dielectric layers 65 and 66, respectively. Bias DC voltage levels are used in conjunction with the two sets of diodes to independently enable and disable the two antenna elements. In this embodiment, two feeds 68 and 69 are connected to the inner antenna element 62, and two feeds 70 and 71 are connected to the outer antenna element 63. In both cases, the two feeds are positioned 90 degrees apart spatially, and are fed 90 degrees out of phase electrically to provide right hand circular polarized RF signals. Antenna control circuitry may be placed on a circuit board 80 mounted on the under side of the ground plane 64. The details of the circuitry are shown in FIG. 7. To select one of the two antennas, a control bias voltage level is generated by the circuitry. The two sets of diodes are biased so that a negative DC voltage selects a first mode that enables one antenna element, while a positive DC voltage disables the second element. Reversing the diode biases reverses the active and inactive elements. Preferably, a +5 V control bias applied to the antenna enables the nominal antenna element and disables the RFI-resistant antenna element, providing compatibility with existing antenna systems. Applying +12 volts DC control bias to the antenna, on the other hand, will enable the RFI-resistant element and disable the nominal element.

A bottom support plate 72 provides mechanical support for the antenna, which may be mounted to the ground plate 64 using several threaded fasteners 73. Nylon fasteners 74 are used to mount the antenna elements 62 and 63 to the ground plane 64. An output connector 75 is used to connect the antenna to a GPS receiver. The inner circular patch is a compact element, having a broad radiation pattern. The dielectric constant of the inner circular patch substrate 65 is typically 4.75, resulting in a patch diameter that is 25% of the design wavelength of interest. The dielectric constant of the outer annular patch substrate 66 is typically 2.94. This results in an annular inner diameter of 32%, and an outer diameter of 59% of the design wavelength. The thickness of the substrates 65 and 66 is typically 0.02 wavelength.

FIG. 7 shows an electrical schematic of the circuitry associated with the antenna of FIGS. 6A and 6B. Like the circuit described in relation to FIG. 2, a low noise amplifier 81 provides a low system noise figure for the satellite receiver, and DC blocking capacitors 82 isolate the low noise amplifier from the DC control voltages. Also similar to FIG. 2, RF chokes 83 de-couple the DC control voltage from the center conductor of the feed line. The de-coupled control voltage is fed to the comparator 84 which controls the PIN diode driver 85 which manages the voltages and currents fed to the PIN diodes 67. Unique to this circuit is the switch 86 and the 90 degree hybrid combiners 88. The switch 86 is used to direct the received satellite signals from the inner circular patch antenna 62 or the outer annular patch antenna 63, as desired. This switch also carries the negative DC diode bias, which is used to enable the desired antenna element. The hybrid combiners 88 combine the signals appearing on the two feeds 68 and 69, or 70 and 71, as desired. The combiner also provides the necessary 90 degree phase shift to ensure that circular polarization is achieved. Similar to the rectangular antenna configuration, a control bias voltage level from +3 to +7.5 volts DC will enable the nominal mode, while a level from +7.5 to +12 volts DC will activate the anti-jam mode.

In another embodiment of the invention, a dual-element patch antenna may be used to combat interference on two separate radio frequency bands. The geometry of the antenna may be identical to the arrangement in FIGS. 1A and 1B with the exception that the upper 14 and lower 13 antenna elements are tuned for two different radio navigation frequencies. For example, the lower element 13 may tuned to the GPS L5 frequency of 1176.45 MHz, while the upper element 14 is tuned to the L1 frequency of 1575.42 MHz. A satellite radio navigation system obtains improved navigation accuracy and integrity by using both satellite frequencies simultaneously. However, if strong interference occurs on one frequency band, it could effectively jam both frequencies simultaneously by overloading the first stage of the receiver. The dual-mode antenna of the present invention allows either the L1 or L5 antenna to be selectively inactivated, as necessary, to mitigate the interference present on that particular frequency. The antenna is completely compatible with existing dual-frequency antennas and can be fabricated and/or packaged in the same size and shape. This concept may be applied to the circular symmetric antenna as well. Both the circular inner 62 and annular outer 63 patch antennas can be designed to have broad radiation patterns, each at a different frequency (e.g., L1 and L5). If interference were present on one frequency (L1 or L5), then one could deactivate that patch, leaving the other (L5 or L1) patch active.

In addition, the reverse biased PIN diodes may be used to tune a patch antenna's resonant frequency. In some embodiments, varactor diodes may replace the PIN diodes and a continuously variable control voltage can be used to tune the antenna to any desired frequency within a band of interest. The polarization properties of the antenna are preserved during this frequency shifting process. This modified antenna may be used to tune over a wide frequency band, and may be useful in radio systems where the frequency band of operation is wider than the inherent bandwidth of the patch antenna. This modification has wide applicability to any radio service, and is not limited to radio navigation satellite use.

Although several embodiments of the present invention and its advantages have been described in detail, it should be understood that the present invention is not limited to or defined by what is shown or discussed herein; rather, the invention may be practiced with the specific details herein omitted or altered. The drawings, description and discussion herein illustrate technologies related to the invention, show examples of the invention and provide examples of using the invention. Known methods, procedures, systems, circuits or components may be discussed or illustrated without giving details, so to avoid obscuring the principles of the invention. One skilled in the art will realize that changes, substitutions, and alternations could be made in numerous implementations, modifications, variations, selections among alternatives, changes in form, and improvements without departing from the principles, spirit or legal scope of the invention.

What is claimed is:

1. An antenna comprising a ground plane, a first planar antenna element positioned above the ground plane, a second planar antenna element positioned above the ground plane, a plurality of diodes connected to the antenna elements, and antenna control circuitry connected to the antenna elements providing first and second voltage bias levels, wherein the first voltage bias level acts in conjunction with the diodes to enable the first antenna element and disable the second antenna element, and the second voltage bias level acts in conjunction with the diodes to enable the second antenna element and disable the first antenna element.

2. The antenna of claim 1 wherein the first antenna element, second antenna element, and ground plane are stacked with dielectric separating layers.

3. The antenna of claim 1 wherein the first antenna element has a first radiation pattern and the second antenna element has a second radiation pattern, and wherein the first radiation pattern has a stronger horizon sensitivity than the second radiation pattern and has a weaker zenith sensitivity than the second radiation pattern.

4. The antenna of claim 1 wherein the first and second antenna elements have polygonal shapes.

5. The antenna of claim 1 wherein the first antenna element has a circular shape and the second antenna element has an annular shape.

6. The antenna of claim 1 wherein the plurality of diodes comprises a first set of diodes connected to the first antenna element, and a second set of diodes connected to the second antenna element, wherein the first set of diodes have a first common bias, the second set of diodes have a second common bias, and the first common bias is opposite to the second common bias.

7. The antenna of claim 1 wherein a first set of diodes connects the first antenna element to the second antenna element, and a second set of diodes connects the second antenna element to the ground plane.

8. The antenna of claim 1 wherein a first set of diodes connects the first antenna element to the ground plane, and a second set of diodes connects the second antenna element to the ground plane.

9. A patch antenna comprising:

a first patch antenna element having a first radiation pattern, a second patch antenna element having a second radiation pattern, and a control circuit for switching between a first operational mode wherein the first patch antenna element is enabled and the second patch antenna element is disabled and a second operational mode wherein the second patch antenna element is enabled and the first patch antenna element is disabled, wherein the first and second patch antenna elements are in proximity to each other, and wherein the first and second patch antenna elements are electromagnetically coupled to each other if the first and second patch antenna elements are both enabled.

10. The antenna of claim 9 wherein the first radiation pattern has stronger sensitivity at an elevation angle of zero degrees than the second radiation pattern, and wherein the first radiation pattern has a weaker sensitivity at an elevation angle of 90 degrees than the second radiation pattern.

11. The antenna of claim 9 wherein the first and second antenna elements have polygonal shapes.

12. The antenna of claim 9 wherein the first antenna element has a circular shape and the second antenna element has an annular shape.

13. The antenna of claim 9 further comprising a first set of diodes connected to the first antenna element, and a second set of diodes connected to the second antenna element, wherein the first set of diodes have a first common bias, the second set of diodes have a second common bias, and the first common bias is opposite to the second common bias.

14. The antenna of claim 9 wherein a first set of diodes connects the first antenna element to the second antenna element, and a second set of diodes connects the second antenna element to the ground plane.

15. The antenna of claim 9 wherein a first set of diodes connects the first antenna element to the ground plane, and a second set of diodes connects the second antenna element to the ground plane.

* * * * *

UNITED STATES PATENT AND TRADEMARK OFFICE

CERTIFICATE OF CORRECTION

PATENT NO. : 6,930,639 B2
APPLICATION NO. : 10/390331
DATED : August 16, 2005
INVENTOR(S) : Bauregger et al.

It is certified that error appears in the above-identified patent and that said Letters Patent is hereby corrected as shown below:

Col. 1, line 4, insert:

-- FEDERALLY-SPONSORED RESEARCH OR DEVELOPMENT

This invention was made with Government support under contract 95-G-005 awarded by the FAA Technical Center. The Government has certain rights in this invention. --

Signed and Sealed this
Ninth Day of August, 2011

David J. Kappos

David J. Kappos
*Director of the United States Patent and Trademark Office*